US007845692B2

(12) United States Patent
Inan et al.

(10) Patent No.: US 7,845,692 B2
(45) Date of Patent: Dec. 7, 2010

(54) MOTOR VEHICLE DOOR LATCH

(75) Inventors: Ömer Inan, Dorsten (DE); Frank Kunst, Lüdinghausen (DE)

(73) Assignee: Kiekert AG, Heiligenhaus (DE)

( * ) Notice: Subject to any disclaimer, the term of this patent is extended or adjusted under 35 U.S.C. 154(b) by 470 days.

(21) Appl. No.: 11/916,658

(22) PCT Filed: Jun. 8, 2006

(86) PCT No.: PCT/DE2006/000982

§ 371 (c)(1),
(2), (4) Date: Dec. 6, 2007

(87) PCT Pub. No.: WO2006/133673

PCT Pub. Date: Dec. 21, 2006

(65) Prior Publication Data

US 2008/0202176 A1 Aug. 28, 2008

(30) Foreign Application Priority Data

Jun. 16, 2005 (DE) ..... 10 2005 027 734

(51) Int. Cl.
*E05C 3/06* (2006.01)
*E05C 3/16* (2006.01)

(52) U.S. Cl. ..... 292/216; 292/341.12; 292/DIG. 56; 292/DIG. 73

(58) Field of Classification Search ..... 292/216, 292/341.12, DIG. 56, DIG. 73
See application file for complete search history.

(56) References Cited

U.S. PATENT DOCUMENTS

| | | | | | |
|---|---|---|---|---|---|
| 4,165,112 | A | * | 8/1979 | Kleefeldt | 292/216 |
| 4,941,696 | A | * | 7/1990 | Yamada et al. | 292/340 |
| 5,064,229 | A | * | 11/1991 | Hamada et al. | 292/216 |
| 5,727,825 | A | * | 3/1998 | Spurr | 292/341.12 |
| 5,918,918 | A | * | 7/1999 | Mosley | 292/341.12 |
| 6,024,389 | A | * | 2/2000 | Arabia et al. | 292/216 |
| 6,789,825 | B2 | * | 9/2004 | Kalargeros et al. | 292/216 |
| 7,195,292 | B2 | * | 3/2007 | Ketelsen et al. | 292/216 |

FOREIGN PATENT DOCUMENTS

| | | | | |
|---|---|---|---|---|
| DE | 43 03 532 | A1 | | 8/1994 |
| DE | 44 20 185 | A1 | | 12/1995 |
| DE | 196 52 012 | A1 | | 6/1998 |
| EP | 0 995 870 | A | | 4/2000 |
| FR | 2243314 | | * | 4/1975 |
| FR | 2498238 | | * | 7/1982 |
| FR | 2786524 | A1 | * | 6/2000 |
| GB | 2 379 954 | A | | 3/2003 |
| JP | 04131484 | A | * | 5/1992 |
| JP | 05156854 | A | * | 6/1993 |
| JP | 2003113687 | A | * | 4/2003 |
| WO | 2006/021190 | A1 | | 3/2006 |

* cited by examiner

*Primary Examiner*—Carlos Lugo
(74) *Attorney, Agent, or Firm*—Matthias Scholl, PC; Matthias Scholl

(57) ABSTRACT

Taught is motor vehicle door latch with at least one locking mechanism (1, 2) comprising a catch (1); a pawl (2); a friction brake device (10); an end stop (13); and at least one cam (14). The friction brake device (10) cooperates with the cam (14) during the closing movement of the locking mechanisms (1, 2) and shortly before said friction brake device (10) reaches the end stop (13). The cam (14) and the catch (1) each comprise means for reducing noise associated with the closing movement of the locking mechanisms (1, 2).

7 Claims, 8 Drawing Sheets

14b
14
14a
11a
14c
11b
10
19
11
13
4
15
1
9
G
7
20
20a
8
2
3
6

4
11b
14
14b
10
11a
19
14a
11
14c
13
15
1
20
G
20a
7
8
2
6
3

MOTOR VEHICLE DOOR LATCH

CROSS-REFERENCE TO RELATED APPLICATIONS

This is a National Stage Application of International Patent Application No. PCT/DE2006/000982, with an international filing date of Jun. 8, 2006, which is based on German Patent Application No. 10 2005 027 734.9, filed Jun. 16, 2005. The contents of both of these specifications are incorporated herein by reference.

BACKGROUND OF THE INVENTION

1. Field of the Invention

The invention relates to a motor vehicle door latch with at least one locking mechanism comprising a catch and a pawl and a flexible friction brake device for the locking mechanism that, as part of a closing movement of the locking mechanism only becomes effective shortly before reaching a rigid end stop, in which the locking mechanism comprises at least one cam in reciprocal action with the friction brake device as it assumes its closing position.

2. Description of the Prior Art

In motor vehicle door latches, as described for instance in DE 44 20 185 A1, the friction brake device ensures that the impact noise of the catch when coming into contact with the end stop, is effectively reduced. For this purpose, DE 44 20 185 A1 provides a cam on the catch or forked catch, with the friction brake device being designed as a leaf spring protruding in the path of movement of the cam shortly before reaching the closing position of the forked catch. This leaf spring slows down the catch as desired. It can, however, be improved with regard to its acoustic behavior. At this point, noise can still be expected, as the steel forked catch comes into contact with the leaf spring made of the same material.

DE 196 52 012 A1 also uses a leaf spring as a friction brake device. In this case, the main objective is, however, the prevention of the opening noises and not of the closing noises.

Finally, DE 43 03 532 C2 discloses a motor vehicle door latch in which the catch contains a conical, oval recess forming the friction brake or friction brake device, into which a tapered, oval section of a cover plate of the door latch engages. This type of device is particularly difficult to produce from a manufacturing point of view. The produced noise is also at a level that is not advantageous.

BRIEF DESCRIPTION OF THE INVENTION

The invention is based on the technical problem of further developing a motor vehicle door latch of the aforementioned design, which while being of a simple design, considerably reduces the produced noise relative to conventional designs.

In order to solve this technical problem, the invention suggests a generic motor vehicle door latch in which the cam is designed to be noise reducing. Preferably, the catch is also designed to be noise reducing, although such a design is not mandatory.

It has shown to be advantageous for the cam to be located on the catch and at the same time being a part of a coating of the catch. Consequently, the cam and the catch are automatically designed to be noise reducing. In this way, noises of the locking mechanism are reliably suppressed, in particular during the closing and the opening. This is because the cam acting upon the friction brake device is acoustically-uncoupled by its plastic coating. This applies in particular when the friction brake device is, for instance, made from steel or is generally made from metal. The same applies to the catch and the end stop, made for instance of steel. As catches in any case increasingly often contain a coating for acoustic reasons, the cam can be easily defined in this coating. This keeps production costs to a minimum, whilst keeping the construction simple.

The invention also embodies the option of producing the cam and the friction brake device in one and the same piece. In this context, it is also advantageous to design the friction brake device as a buffer pocket with a buffer lip and the connected cams, where applicable, which are also part of the plastic coating of the catch. Where the buffer pocket contains the cam which in turn is in reciprocal action with the end stop in the frame box, the cam and the friction brake device can be more or less produced as one part.

In an alternative embodiment, the cam and the friction brake device are, however, designed as separate units. In this case, the friction brake device on the latch housing and/or on the locking mechanism is arranged independently from the cam. The friction brake device can be designed as a single component together with the latch housing and/or the locking mechanism and/or a part of the latch housing and or the locking mechanism. Where the latch housing is made of plastic, it is recommended, in this context, to also use a plastic friction brake device and to form or spray it onto the latch housing.

It is also particularly advantageous to design the friction brake device as a spring lip in reciprocal action with the catch as part of its closing movement. This spring lip is therefore preferably made of plastic. It normally has a shape, surrounding the cam on the locking mechanism or the catch, and generally when the locking mechanism or the catch is in the closing position or in the so-called overtravel position. This overtravel position corresponds with the catch bolt engaging in a feed-in mouth of the catch, moving said catch past the primary position of the closing operation. This can occur manually by an operating person or by motorized means, by for instance an assisted door closing system.

Such an overtravel is generally required to ensure a reliable engagement of the pawl in the primary position of the catch, taking into consideration the tolerances required for the closing movement. The motor vehicle door latch contains an end stop for limiting the overtravel. As a result of the friction brake device surrounding the cam—in reciprocal action with said device—in the overtravel position or the cam generally not being effective in the overtravel position, e.g. the friction brake device is not acted upon, the catch is hardly or not at all slowed down by the friction brake device in this position. In this way, resetting forces created anyway with the overtravel due to elasticities inevitably present, such as a rubber door seal, ensure that the locking mechanism or the catch are pushed back into the primary position. During this process, the friction brake device is not active or is hardly active, or there is no reciprocal action, or only a weak reciprocal action, between the cam and the friction brake device.

Otherwise, the friction brake device generally increasingly builds up resetting forces as the closing distance increases. This is intentional in order to provide increased braking of the catch bolt engaging in the catch. In this context, the locking mechanism ensures that the friction brake device is increasingly deformed as it assumes its closing position. This is ensured by the cam in reciprocal action with the friction brake device, which with its eccentric shape increasingly acts upon the friction brake device up to the primary position, with the deformation forces, which act on the friction brake device in the connected overtravel area and which are produced by the cam, being reduced.

The result is a motor vehicle door latch that is advantageous because of its well-contrived noise characteristics and simple design. This is, first of all, achieved with the friction brake device, braking the locking mechanism and thus the catch bolt moving into the catch as it assumes its closing position (in most cases the primary position). The locking mechanism and its cam with its eccentric shape actually ensure that the friction brake device is increasingly acted upon during the closing operation, resulting in increasing mechanical friction and thus braking forces.

After passing the primary position and thus being present in the overtravel area, the cam and the friction brake device ensure that the frictional forces produced as a result are reduced to a minimum. As a result, the then effective resetting forces can easily return the locking mechanism into its primary position after the pawl has been perfectly engaged. All advantages can, of course, also be gained when the pawl engages in the intermediate closed position, or, also, when the cam is positioned on the pawl instead of on the catch, which in this case will be covered by a coating. Generally, this can, of course, be advantageous for any motor vehicle door latch, for instance not only those used on side doors but also for those used on tailgates, motor hoods, etc., also falling under the generic term of vehicle door latch as used in this application.

BRIEF DESCRIPTION OF THE DRAWINGS

Below, the invention is explained in more detail with reference to a drawing showing only one embodiment, in which.

DETAILED DESCRIPTION OF THE INVENTION

Figure 1:
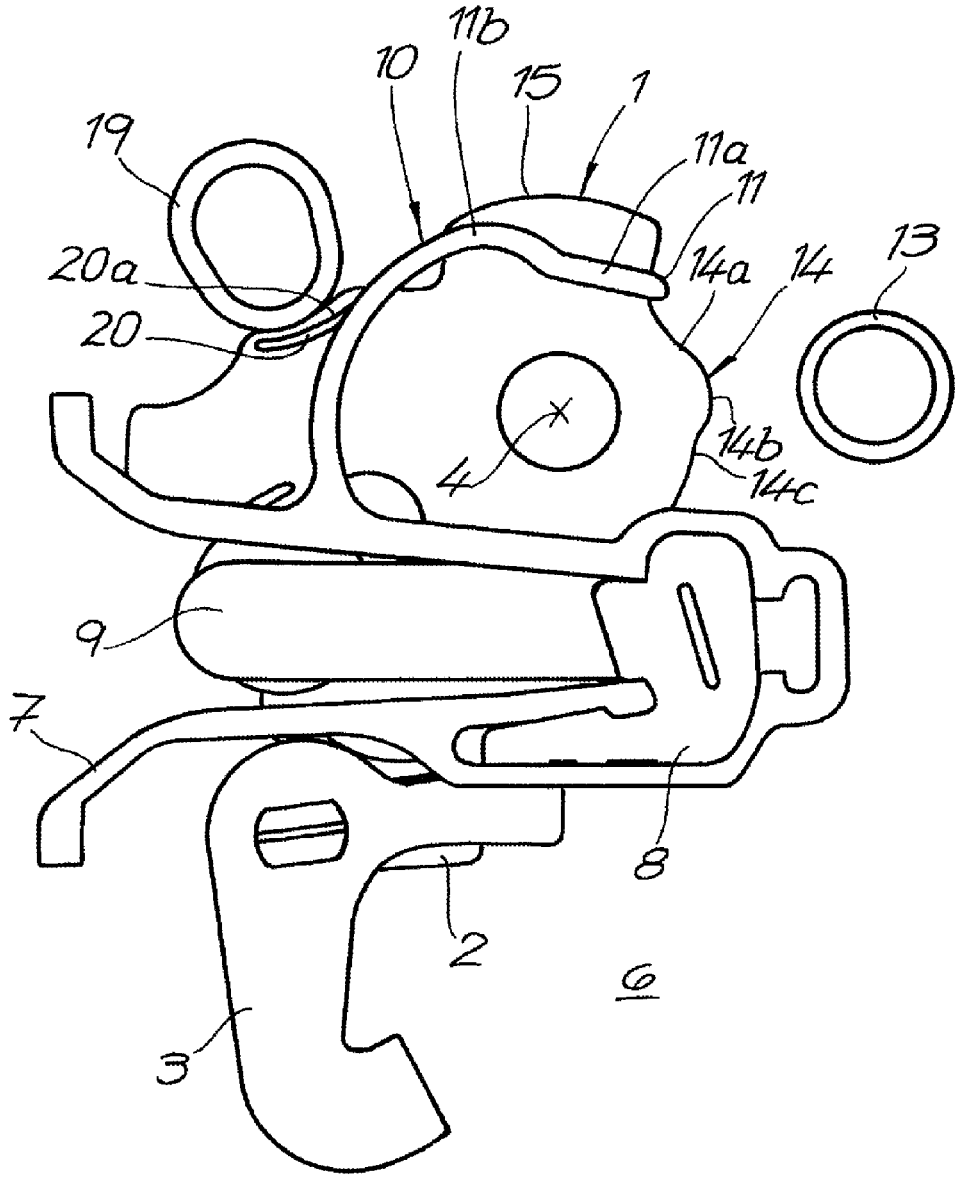
FIGS. 1 and 2 show two different views of a first embodiment of the motor vehicle door latch according to the invention in an open position.

The figures show a motor vehicle door latch whose general design consists of a locking mechanism 1, 2 comprising a catch 1 and pawl 2. In this embodiment, the pawl 2 is located on an actuating lever 3 although the invention is not restricted to this arrangement. Any pulling movement on this actuating lever 3 in the direction shown in FIG. 4 causes the pawl 2 to release the catch 1 from the shown primary position and the catch to be displaced counter-clockwise with the aid of a spring, as also shown by the arrow on the catch 2 in FIG. 4, with the catch 1 revolving around its axis 4. Catch 1 and pawl 2 as well as the actuating lever 3 are accommodated together in a frame box 5, which is only indicated.

In addition to the frame box 5, a latch housing 6 is provided, of which only certain individual parts can be recognized in the figures, which will be explained below. The latch housing 6, made of plastic, actually includes a feed-in mouth or feed-in mouth insert 7, containing a stop absorber 8. The stop absorber 8 restricts the movement of a catch bolt 9 when entering the feed-in mouth 7 and the catch 1. The feed-in mouth 7 (or the feed-in mouth insert), and thus the latch housing 6, contains a shaped friction brake device 10, which in the first embodiment shown in FIGS. 1 to 5 is designed as spring lip 11. The friction brake device 10 as part of the embodiment shown in FIGS. 6 to 8, on the other hand, is designed as a buffer pocket 12 arranged on the locking mechanism 1, 2.

Figure 3:
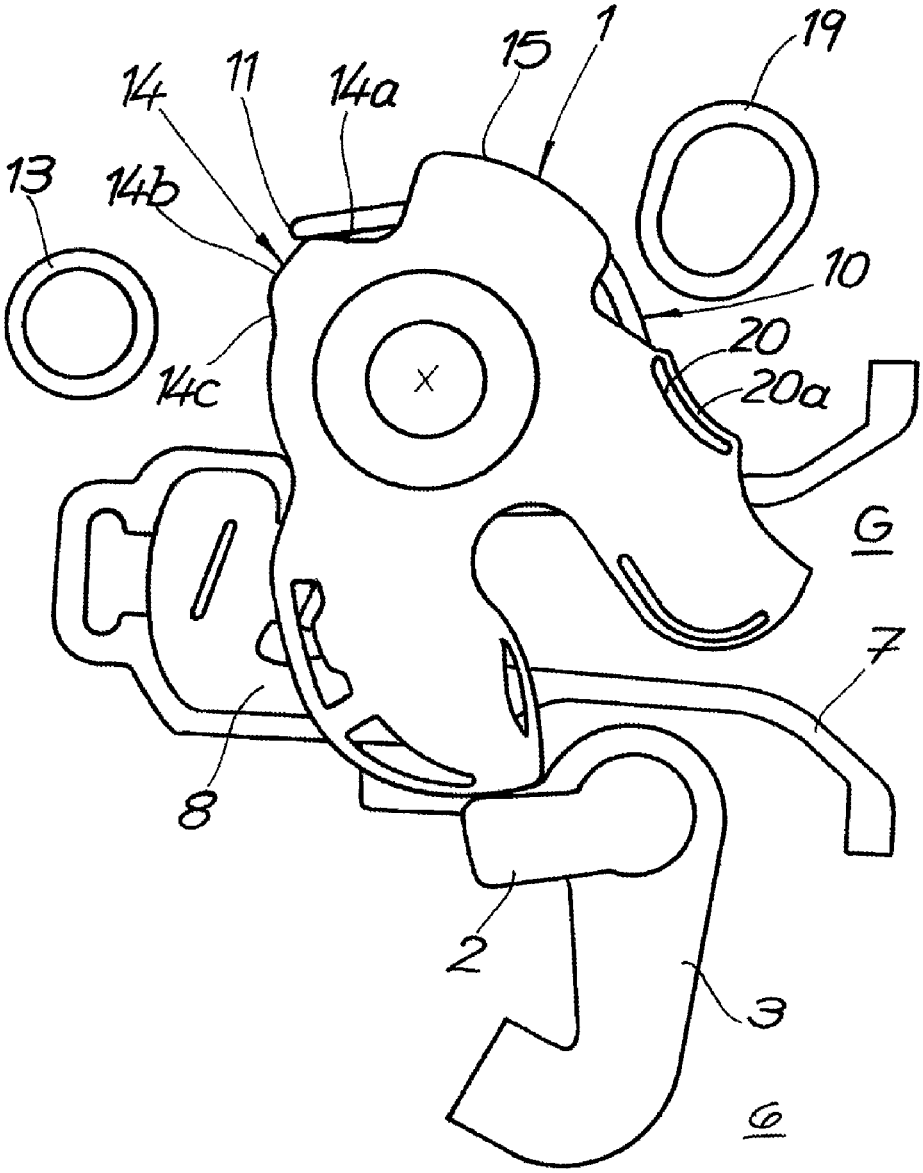
FIGS. 3 and 4 show the motor vehicle door latch according to FIGS. 1, 2 on the way towards the primary position.
Figure 5:
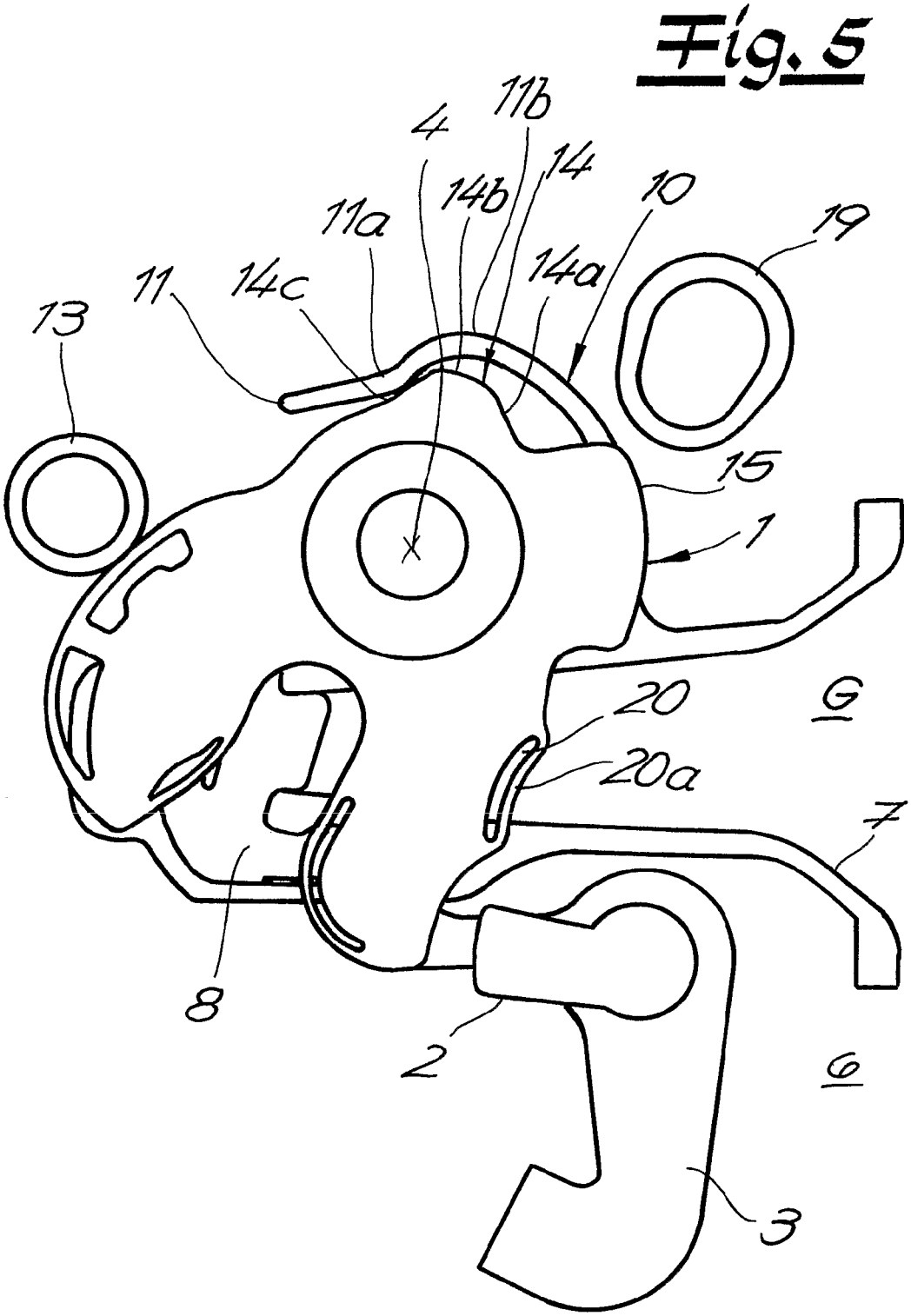
FIG. 5 shows the motor vehicle door latch according to FIGS. 1 to 4 in the overtravel area.
Figure 8:
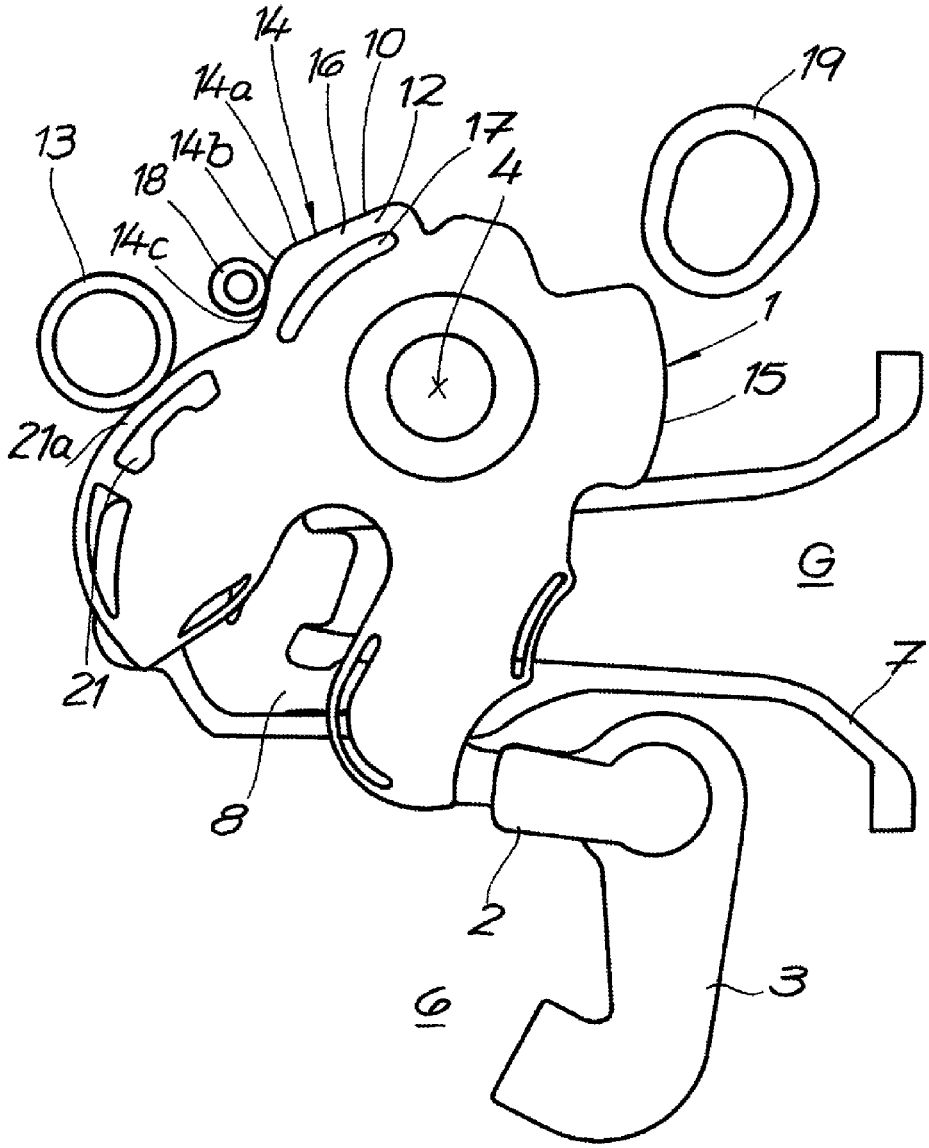
FIG. 8 shows the object according to FIGS. 6 and 7 in the overtravel area.

The friction brake device 10 for the locking mechanism 1, 2 has a flexible design and only becomes effective shortly before reaching the rigid end stop 13 (see FIGS. 5 and 8). In the embodiment, although not limiting to the invention, the friction brake device 10 becomes effective shortly before reaching the intermediate closed position as shown in FIG. 3 and ending in the overtravel area as shown in FIGS. 5 and 8. At the same time, the friction brake device 10 acts reciprocally with the cam 14 on the locking mechanism 1, 2. In other words, the friction brake device 10 and the cam 14 together form a functional unit 10, 14, ensuring that the catch bolt 9 moving into the feed-in mouth 7 and with it the locking mechanism 1, 2 are slowed down en route to the primary position.

In comparison, the functional unit 10, 14 or the friction brake device 10 in combination with the cam 14 on the locking mechanism 1, 2 does not (does no longer) considerably influence the movement of the catch bolt 9 and thus of the locking mechanism 1, 2 in the overtravel area, as shown in FIGS. 5 and 8. Instead, considerable resetting forces are exerted in the reached overtravel area by, for instance, the surrounding rubber door seal, ensuring that the catch bolt 9 and the locking mechanism 1, 2 are pushed back into the primary position. In this case, additional braking forces generated by the friction brake device 10 in connection with the cam 14 would more than likely be a hindrance and are actually not, or are hardly, taken into consideration.

In order to achieve an effective noise muffling of the entire motor vehicle door latch, cam 14 has a noise-reducing design. Catch 1 is actually designed with a plastic coating 15, also covering cam 14. In other words, the cam 14 is formed in the plastic coating 15 during its manufacture. In this way, cam 15 is also automatically made of plastic or contains a coating and thus acts between the catch 1 made of steel and the friction brake device 10 as an acoustic decoupling means.

Figure 2:
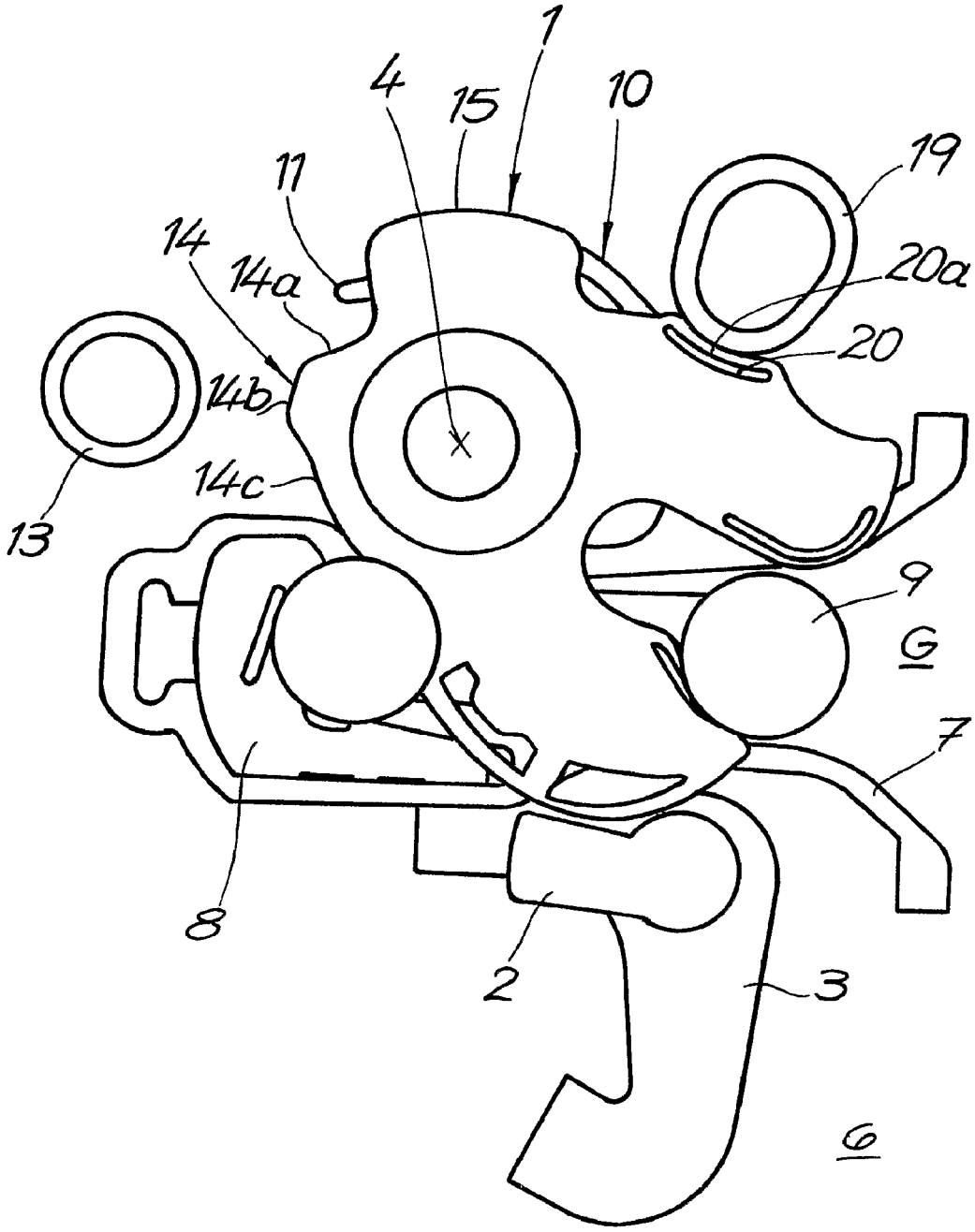

From the embodiments shown in FIGS. 1 to 5, it is apparent that cam 14 protrudes out of the locking mechanism's plane G created by catch 1 in connection with pawl 2 in the direction of the feed-in mouth 7 which is arranged behind it, as shown in FIGS. 1 and 2. As a result, cam 14 is positioned directly in the sphere of influence of the friction brake device 10, arranged more or less on the same plane as the feed-in mouth 7 and, in this case, the spring lip 11 on the feed-in mouth 7. As soon as catch 1 moves into its closing position, the cam 14 increasingly moves towards the friction brake device 10 or the spring lip 11, reaching it shortly before the intermediate closed position, shown in FIG. 3, is taken up. As a result, the friction brake device 10 or the spring lip 11 is able to transfer mechanical frictional forces onto the locking mechanism 1, 2, braking its movement.

As a result of the eccentric shape of the cam 14 with its rising flank 14*a*, the friction brake device 10 or the spring lip 11 is increasingly deformed so that progressively increasing resetting forces or brake forces are generated by the friction brake device 10 as the closing operation progresses. Shortly before reaching the primary position, as shown in FIGS. 4 and 6, the maximum deformation of the friction brake device 10 is reached, corresponding in space to the plateau area 14*b* of the cam 14.

Figure 4:
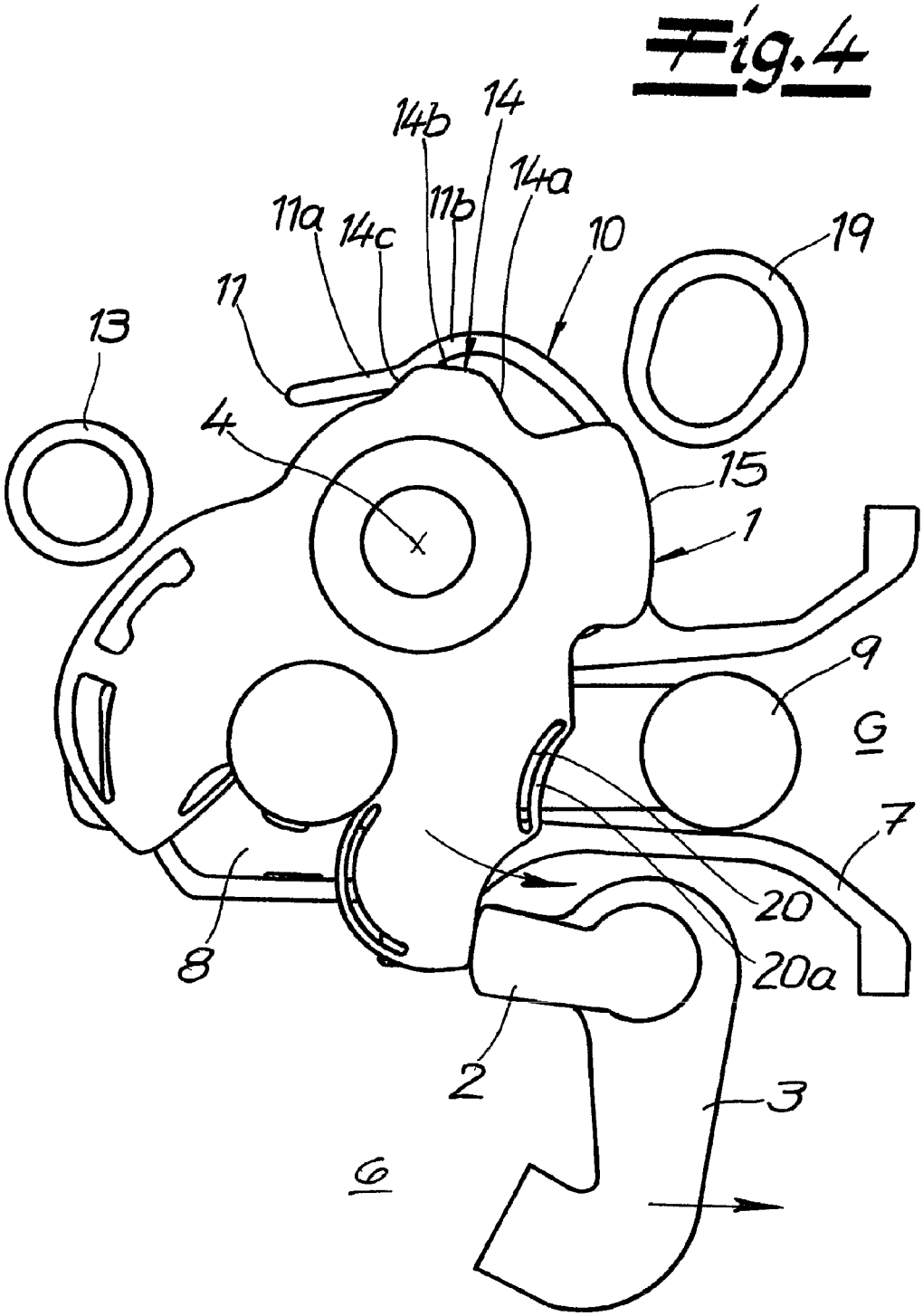
Figure 6:
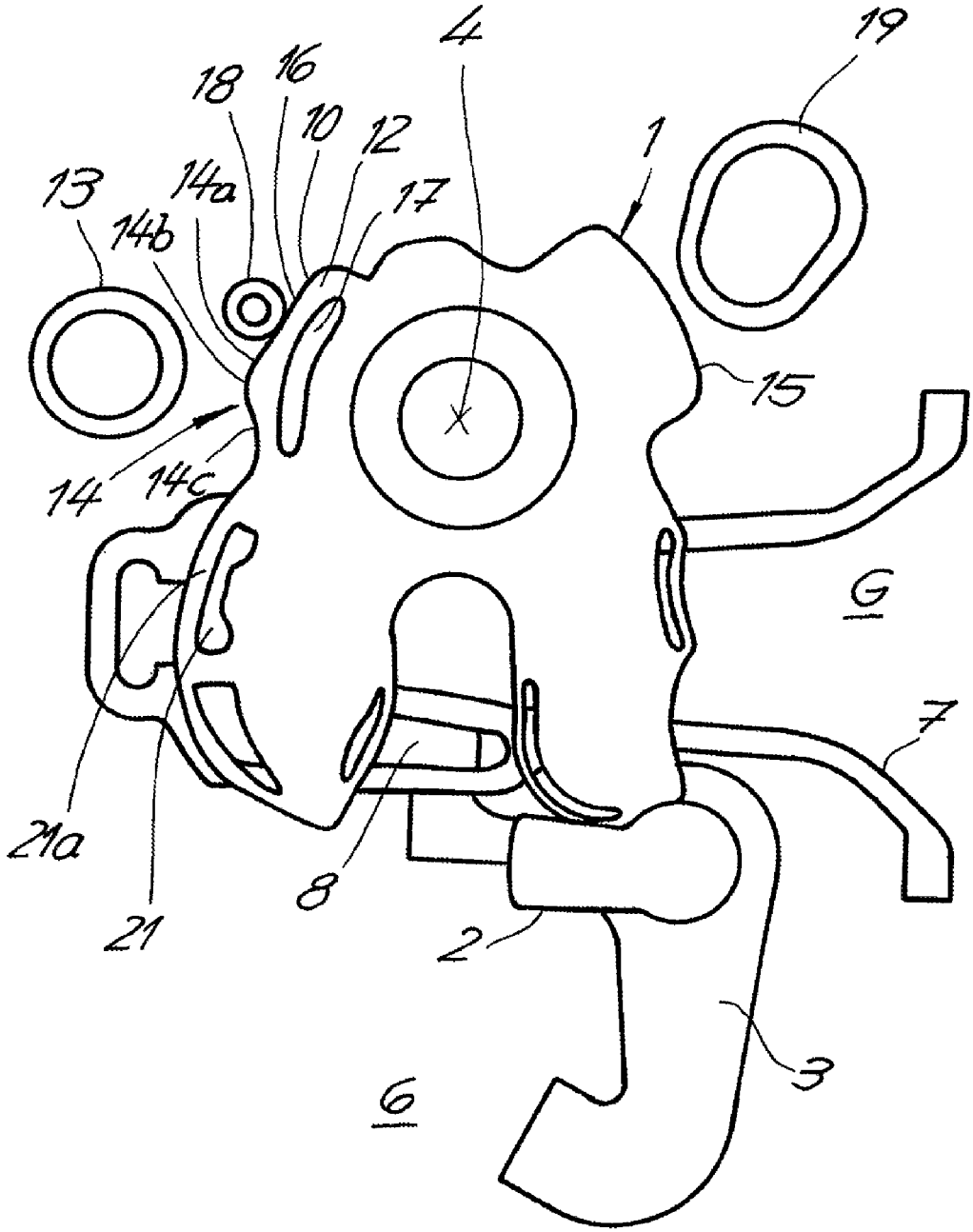
FIG. 6 shows an alternative embodiment on the way towards the primary position.

When the locking mechanism 1, 2 is moved past the primary position, as shown in FIGS. 4 and 6, it reaches the overtravel area, as shown in FIGS. 5 and 8. In this overtravel area, the falling flank 14*c* of the cam 14 is in reciprocal action with the friction brake device 10 so that in this position only few or no frictional forces are created. Further movement of the locking mechanism 1, 2 is now limited by the end stop 13. At the same time, the friction brake device 10 or the spring lip 11 has covered cam 14 in this position (see FIG. 5), so that basically no brake forces are created and the locking mechanism 1, 2 can easily return to the primary position. For this purpose, the friction brake device 10 or spring lip 11 has a two-part contour with a contact area 11*a* and a by-pass area 11*b* for cam 14. The desired reciprocal action between the spring lip 11 and the cam 14 is indeed produced in the contact area 11*a*, whilst the by-pass area 11*b* basically separates the cam 14 from the spring lip 11.

Figure 7:
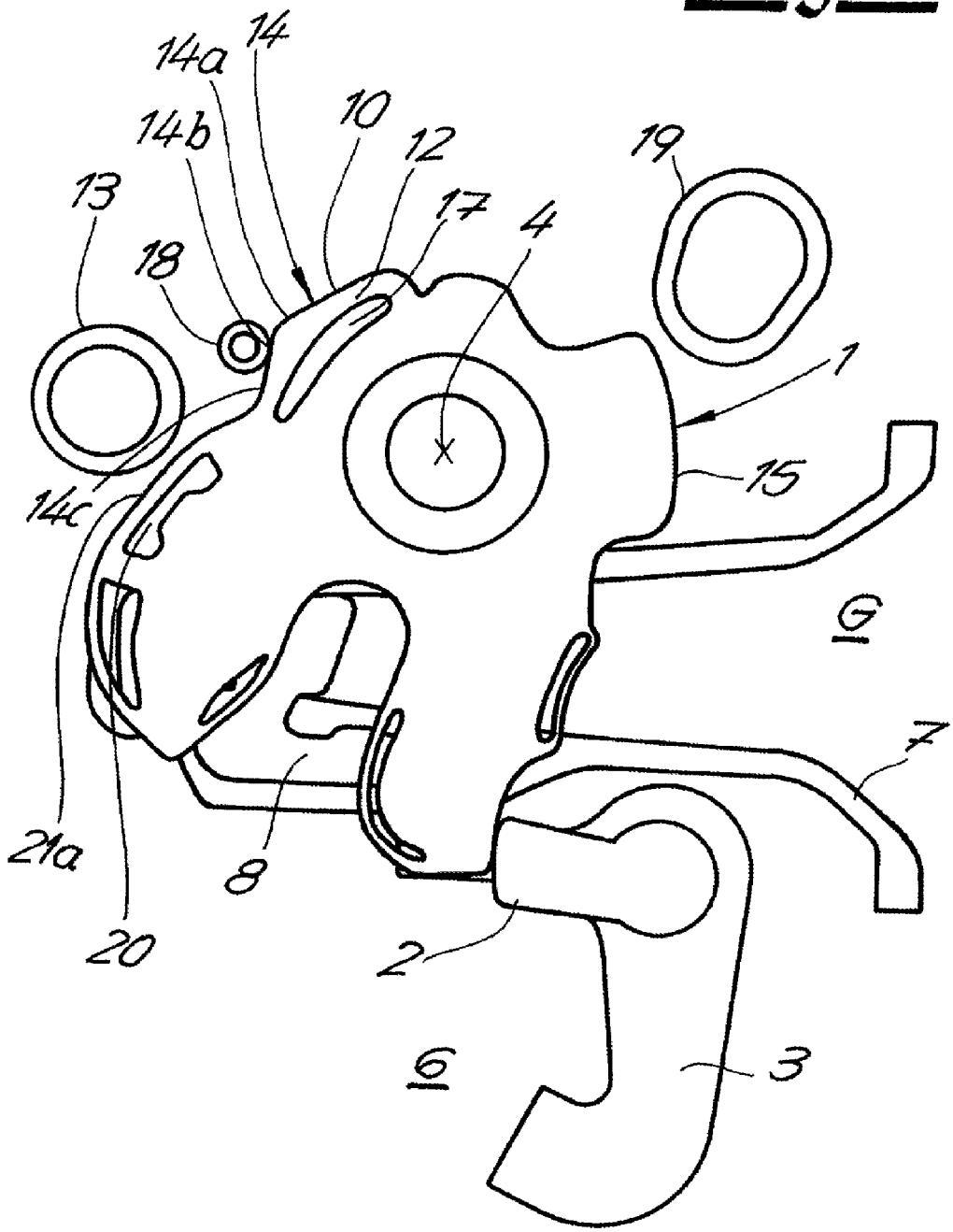
FIG. 7 shows the object according to FIG. 6 in the primary position.

The alternative embodiment, shown in FIGS. 6 to 8, functions similarly to that described above. The only difference is that the cam 14 together with the friction brake device 10 constitutes a single part, while in the embodiment according to FIGS. 1 to 5 the friction brake device 10 and the cam 14 constitute separate parts. The first embodiment also uses a friction brake device 10 on the housing side, while the alternative embodiment, shown in FIGS. 6 to 8, features a friction brake device 10 on the locking mechanism side.

The friction brake device 10 is indeed designed as a buffer pocket 12 in this case, as already explained above. This buffer pocket 12 comprises a buffer lip 16 and a buffer slot 17, permitting movement of the buffer lip 16. Buffer lip 16 has the same function as spring lip 11. The only difference is that buffer lip 16 contains the integral cam 14, which in turn acts upon the buffer lip 16 by means of a stop 18 fixed to the housing.

As soon as the locking mechanism 1, 2 moves towards the intermediate closed position, stop 18 is in reciprocal action with cam 14 on the buffer lip 16, ensuring increasing braking forces. As a result, the buffer lip 16—like the spring lip 11 before—is increasingly deformed. Upon reaching the primary position, as shown in FIG. 7, the plateau 14*b* of the cam 14 has passed the stop 18, corresponding with the aforementioned maximum deformation of the buffer lip 16. The falling flank 14*c* of the cam 14 is then in reciprocal action with stop 18, so that hardly any braking forces are still exerted in the following overtravel area, as shown in FIG. 8, and catch 1 runs directly against the end stop 13.

Finally, it is apparent that the spring pocket 20 and spring pocket 21 are assigned to the end stop 13 and the further open stop 19, respectively, in order to prevent in any case a hard impact of the catch 1. The spring pockets 20, 21 are in turn formed in the plastic coating 15 and contain a slot or slit, accommodating the deformation of an associated slit lip 21*a* or 20*a*.

The invention claimed is:

1. A motor vehicle door latch comprising: a locking mechanism (1, 2) comprising:

a housing having a feed-in mouth with side walls defining a cavity to receive a catch bolt and a friction break spring lip extending from one of said sidewalls of said cavity;

a catch pivoted between an open position, an intermediate position, an overtravel position, and a closed position; said catch comprising a cam portion and means for reducing noise associated with the closing movement of said locking mechanism;

a pawl for maintaining said catch in said closed position; and an end stop;

wherein when the catch bolt is inserted into said housing, the catch bolt will move said catch from said open position toward said intermediate position so that said cam portion will contact said friction break spring lip to slow down the closing movement of said locking mechanism up to said intermediate position; and wherein further insertion of the catch bolt into said housing will make said catch further move to said overtravel position, wherein said catch can contact said end stop, so as to prevent further movement of said catch, making said catch move to said closed position.

2. The motor vehicle door latch of claim 1, wherein said means for reducing noise is a plastic coating.

3. A motor vehicle door latch comprising a locking mechanism comprising:

a housing;

a catch pivoted between an open position, an intermediate position, an overtravel position, and a closed position; said catch comprising a cam portion and means for reducing noise associated with the closing movement of said locking mechanism; said cam portion comprising a friction break buffer;

a pawl for maintaining said catch in said closed position;

a friction stop; and an end stop;

wherein when the catch bolt is inserted into said housing, the catch bolt will move said catch from said open position toward said intermediate position so that said friction break buffer of said cam portion will contact said friction stop to slow down the closing movement of said locking mechanism up to said intermediate position; and wherein further insertion of the catch bolt into said housing will make said catch further move to said overtravel position, wherein said catch can contact said end stop, so as to prevent further movement of said catch, making said catch move to said closed position.

4. The motor vehicle door latch of claim 1, wherein said friction brake spring lip acts upon said catch as part of the closing movement of said catch.

5. The motor vehicle door latch of claim 4, wherein said friction break spring lip comprises a contact area and a by-pass area surrounding said cam portion in said closing position of said locking mechanism.

6. The motor vehicle door latch of claim 3, wherein said catch comprises a plastic coating, and said friction break buffer is part of said plastic coating.

7. The motor vehicle door latch of claim 1, wherein said locking mechanism acts upon said friction brake spring lip with progressively increasing deformation forces while assuming said closed position, except that locking mechanism does not exert substantial deformation forces on said friction brake spring lip when said locking mechanism is in said overtravel position.

* * * * *